US005757088A

United States Patent [19]

Baeumen et al.

[11] Patent Number: 5,757,088

[45] Date of Patent: May 26, 1998

[54] REMOTE CONTROL DEVICE ESPECIALLY FOR CONVEYING, SPRAYING AND DISTRIBUTING MACHINES FOR CONCRETE AND MORTAR

[75] Inventors: Paul Baeumen, Sindelfingen; Wolf-Michael Petzold, Aichwald, both of Germany

[73] Assignee: Putzmeister-Werk Maschinenfabrik GmbH, Aichtal, Germany

[21] Appl. No.: 716,339

[22] PCT Filed: Mar. 29, 1995

[86] PCT No.: PCT/EP95/01176

§ 371 Date: Sep. 30, 1996

§ 102(e) Date: Sep. 30, 1996

[87] PCT Pub. No.: WO95/28729

PCT Pub. Date: Oct. 26, 1995

[30] Foreign Application Priority Data

Apr. 13, 1994 [DE] Germany ..... 44 12 635.2

[51] Int. Cl.[6] ..... B26F 1/00

[52] U.S. Cl. ..... 307/119; 307/112; 307/140; 307/9.1; 364/424.048

[58] Field of Search ..... 307/112, 113, 307/115, 134, 140, 119, 9.1, 10.1; 192/9; 364/184, 185, 423.098, 423.099, 424.048; 180/116, 123

[56] References Cited

U.S. PATENT DOCUMENTS

| | | | |
|---|---|---|---|
| 3,628,357 | 12/1971 | Luenser | 192/144 |
| 4,053,790 | 10/1977 | Myers | 307/141.4 |
| 4,232,792 | 11/1980 | Shields | 212/160 |

(List continued on next page.)

FOREIGN PATENT DOCUMENTS

| | | |
|---|---|---|
| 2 051 793 | 11/1971 | Germany . |
| 31 14 514 C2 | 3/1983 | Germany . |
| 34 35 651A1 | 4/1986 | Germany . |
| 37 06 325C2 | 9/1988 | Germany . |
| 39 37 122A1 | 5/1991 | Germany . |
| 9114572.4 | 3/1992 | Germany . |
| 40 33 800A1 | 4/1992 | Germany . |
| 42 09 679A1 | 12/1993 | Germany . |
| 5-240153 A | 9/1993 | Japan . |

OTHER PUBLICATIONS

Stahl, Kurt: Pfuschen kann toedlich sein. In: industrie–elektrik + elektronik, 35. Jg., 1990, Nr. 7, S. 40–43.

Herman, Wolfgang; Weber, Stefan: Konstruktiv und strukturell. In: Maschinenmarkt, Wuerzburg 99, 1993, 19, S. 58–63;

Plachetka, Sigmund: Sicherheit durch Redundanz. In: der elektromeister + deutsches elektrohandwerk, Mar. 1989, S. 169, 170.

*Primary Examiner*—William M. Shoop, Jr.
*Assistant Examiner*—Peter Ganjian
*Attorney, Agent, or Firm*—Flynn, Thiel, Boutell & Tanis, P.C.

[57] ABSTRACT

The invention relates to a remote control device for mobile and stationary concrete pumps. The remote control device has a central control device to control groups and signalling units of the concrete pump and a remote control appliance connected to the central control device via a multicore remote control cable. The central control device has an emergency stop switch gear remote controlled by a mechanically actuatable emergency stop switch fitted in the remote control appliance, the power supply to which is taken via a forced first switch contact of the emergency stop switch and which triggers an emergency stop if the power supply fails. In order to ensure reliable emergency cut-off even in the event of a short circuit in the emergency stop system when the emergency stop switch is actuated, there is an overload fuse in the central control-side lead to the first switch contact designed as a break contact. In addition, there is in the emergency stop switch a second forced switch contact designed as a make contact, the first connection of which is connected to the ground terminal of the power source and the second connection of which is connected to the second connection of the first switch contact within the remote control appliance.

7 Claims, 1 Drawing Sheet

U.S. PATENT DOCUMENTS 4,397,561 8/1983 Strong et al. ..... 366/21
4,436,429 3/1984 Strong et al. ..... 366/17
4,436,431 3/1984 Strong et al. ..... 366/17
4,533,300 8/1985 Westerlund et al. .
4,702,403 10/1987 Rail Breaker ..... 225/96.5
5,422,808 6/1995 Catanese, Jr. et al. ..... 364/184

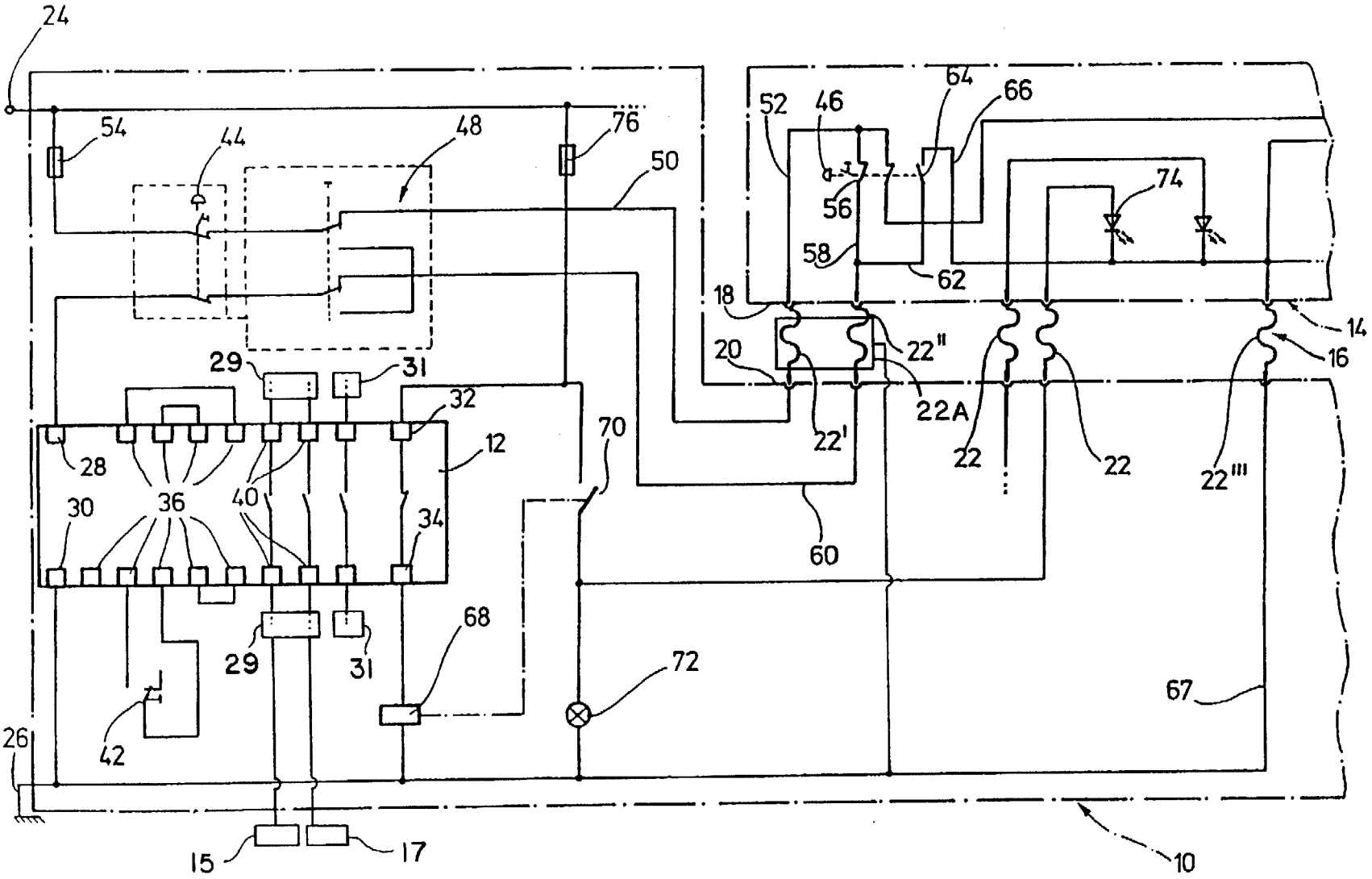
14
16
22'''
67
10
74
22
66
64
62
22A
22''
46
56
58
22'
60
52
18
20
50
76
72
70
12
68
48
32
34
31
17
29
40
15
44
36
42
54
28
30
24
26

REMOTE CONTROL DEVICE ESPECIALLY FOR CONVEYING, SPRAYING AND DISTRIBUTING MACHINES FOR CONCRETE AND MORTAR

FIELD OF THE INVENTION

The invention relates to a remote control device, especially for conveying, spraying and distributing machines for concrete and mortar, having a central control device for controlling aggregates and signalling elements, and having a remote control unit connected to the central control device through a multicore remote control cable. The central control device has an emergency stop switch device for main and control circuits leading to the aggregates and signalling elements, which can be remote controlled by means of a manually mechanically actuatable emergency stop switch or key arranged in the remote control unit. The power supply is guided through a forced first switch contact of the emergency stop switch, which contact is designed as a break contact, and which triggers an emergency cut-off when the power supply is interrupted.

BACKGROUND OF THE INVENTION

In remote control devices for machines of the above type, the possibility of an emergency cut-off in dangerous situations, which can occur due to malfunctions or incorrect operations, on the one hand, or due to happenings in surrounding areas on the other hand, is intolerable. All instantaneous sequences of movement are usually interrupted during an emergency cut-off. Since the emergency stop function is thus of a central importance for reasons of operational safety, suitable precautions must be taken, which guarantee also during a breakdown, a reliable emergency cut-off. In cable remote control devices, consideration must particularly be noted that the long multicore remote control cables can experience a short in a cable in the emergency stop circuit during a rough building site operation, through which the switch contact of the emergency stop switch is bridged, and thus no longer functions. The operator notices hereby only in a case of danger during an operation of the emergency stop switch that the remote control cable is no longer in order.

Starting out from this, the basic purpose of the invention is to further improve the remote control device of the above-disclosed type in such a manner that also in the case of a short in a cable in the emergency stop circuit, especially in the area of the remote control cable, an emergency cut-off is still triggered by operating the emergency stop switch.

To attain this purpose, the characteristic combinations disclosed in claims 1 and 3 are suggested. An advantageous development of the invention results from the dependent claim.

The solution of the invention is based on the thought that also in the case of a short in a cable in the emergency stop circuit it must be assured that during operation of the emergency stop switch, the power supply to the emergency stop switch device is interrupted.

SUMMARY OF THE INVENTION

In order to achieve this, it is suggested according to a first modification of the invention that the first switch contact is connected at its first connection through a first cable core of the remote control cable and an overload fuse to the "hot" pole of a central control side voltage source, and with its second connection through a second cable core of the remote control cable to a power supply connecting terminal of the emergency stop switch device. The emergency stop switch has in addition a forced second switch contact designed as a make contact, the first connection of which is connected to the ground pole of the voltage source, and the second connection of which is short-circuited within the remote control unit to the second connection of the first switch contact, and that the first and the second switch contact react timely one after the other upon operation of the emergency stop switch forming a switch gap. The first and the second switch contact of the emergency stop switch can also be combined in a change-over switch.

With this measure it is achieved that upon operation of the emergency stop switch in the usual case, the power supply connection of the emergency stop switch device is switched over to ground potential and thus triggers the emergency cut-off. The operation of the emergency stop switch leads to a short circuit between the "hot" pole and the ground pole of the voltage source and thus to the triggering of the overload fuse upon a short in a cable in the emergency stop circuit. The "hot" pole of the voltage source is separated by this and the power connecting terminal is changed to ground potential triggering the emergency cut-off.

In a second modified solution of the invention, in which the switch contact of the emergency stop switch is also connected at its first connection through a first cable core of the remote control cable to a "hot" pole of a center control side voltage source and with its second connection through a second cable core to a power supply connecting terminal of the emergency stop switch device, the first and/or second cable core has a shielding cover connected to the ground pole of the voltage source. With this measure it is also achieved, upon a short in a cable in the emergency stop circuit in the area of the remote control cable, that a short circuit triggers the overload fuse. With this it is assured that the emergency stop switch device becomes powerless and triggers the emergency cut-off.

The short in a line is in both cases indicated to the operator by the reaction of the overload fuse. In order to achieve this safety feature, it was necessary, up to now, to design the emergency stop circuit redundant, thus having at least with two channels, with the consequence that a larger cable and a larger plug were necessary, or the functioning operation of the remote control had to be limited.

BRIEF DESCRIPTION OF THE DRAWINGS

The invention will be discussed in greater detail hereinafter in connection with one exemplary embodiment schematically illustrated in the drawing.

The single FIGURE shows a section of an electric circuit diagram of a cable remote control device with a remote-controlled emergency stop switch unit, for example used with an automated concrete pump.

DETAILED DESCRIPTION

The electrical circuit diagram includes a section from a central control device 10 with an emergency stop switch device 12 and a section from a remote control unit 14 for an automated concrete pump. The concrete pump has aggregates or parts 15 and signalling elements 17. The remote control unit 14 is connected to the central control 10 through a multicore remote control cable 16 and suitable plug connections 18, 20. Of the, for example, thirty-two cable cores 22, the drawing shows a total of five.

The central control 10 and the remote control unit 14 are supplied with power from a power supply with, for example, 24 V direct current or alternating current, to the "hot" positive pole 24 (phase) and the grounded pole 26.

The emergency stop switch device 12 has a plurality of connecting terminals 28, 30, 32, 34 and 36 and 40, which can be externally switched. The emergency stop switch device 12 is supplied with power through the terminals 28 and 30, whereby the terminal 30 can be connected galvanically to the ground pole 26 and the terminal 28 through an emergency stop circuit to the hot pole 24. The terminals 36 are intended for the external switching of internal circuits of the emergency stop switch 12, whereas the terminals 40 and 32 and 34 are intended for controlling the external main and control circuits 29, 31 allowing for the operation of the emergency stop functions. The emergency stop switch device 12 is activated with the start key 42. The contacts 40 are thereby closed and the contact 32, 34 is opened. By operating one of the emergency stop switches 44, 46 in the area of the central control or in the area of the remote control unit 14, the contacts 40 or 32, 34 fall back into their base position and trigger an emergency stop. This is done by the connection between the pole 24 of the power supply and the power supply terminal 28 of the emergency stop switch device being interrupted by the emergency stop switches 44 and 46. The respective current supply line can be selectively switched to the remote control unit 14 (as illustrated) or to a local control. An overload fuse 54 is provided on the input side in the lead 50, which is connected to the line 52 of the remote control unit 14 through the cable core 22'. The line 52 is connected in the remote control unit 14 through the switch contact 56 of the emergency stop key 46, which switch contact is designed as a break contact, and thus to the return circuit 58, the cable core 22", and the central control side return circuit 60 to the power supply terminal 28 of the emergency stop device 12 respectively. The terminal 58 is furthermore connected to a terminal 62 of a switch contact 64 of the emergency stop switch 46, which switch contact 64 is designed as a make contact, the other terminal 66 of which is connected through the cable core 22'" to a grounded wire 67 leading to the ground pole 26 of the central control.

If the emergency stop switch 46 is thus operated, the contact 56 opens first and interrupts in this manner the power supplied to the power supply terminal 28 of the emergency stop switch device 12 triggering an emergency cut-off. Shortly after the contact 46 opens, the contact 64 closes and places the input of power supply terminal 28 to ground potential. The emergency stop switch 12 continues to remain currentless in its emergency cut-off state.

It happens again and again in a rough building-site operation that a short in a cable occurs in the individual cores 22 of the remote control cable 16. The first and/or second cable core 22', 22" has a shielding cover 22A connected to ground. A short in a cable between the cores 22' and 22" leads thereby to a bridging of the switch contact 56. Thus, in such a breakdown case an opening of the switch contact 56 upon operation of the emergency stop switch 46 will alone not yet lead to the release of an emergency cut-off. Only when the contact 64 is closed, a short circuit occurs between the lead 50 and the ground wire 66 in the area of the short in the cable, through which the fuse 54 is triggered and the power supply through the line 50 to the power supply terminal 28 is interrupted. This guarantees that also in the case of such a breakdown an emergency cut-off occurs through the device 12.

As has been discussed above, the contacts 32, 34 of the emergency stop switch 12 are open during the activating phase so that the contact 70 of the relay 68 arranged in the respective circuit drops off into its open position. The contact 32 falls in the emergency stop state back into its base position illustrated in the drawing so that the relay contact 70 reaches its closing position and loads the alarm lamps 72 and 74 with current through the fuse 76 and illuminates them.

In conclusion, the following is to be stated: The invention relates to a remote control device, in particular for movable and stationary concrete pumps. The remote control device has a central control device 10 for controlling aggregates 15 and signal units 17 of the concrete pump and a remote control unit 14 connected to the central control device 10 through a multicore remote control cable 16. The central control device has an emergency stop switch device 12, which can be remote controlled by means of a mechanically operable emergency stop switch 46 arranged in the remote control unit 14, the power supply of which emergency stop switch device 12 is taken via a forced first switch contact 56 of the emergency stop switch 46 and which triggers an emergency cut-off if the power supply is interrupted. In order to guarantee reliable emergency cut-off even in the event of a short circuit in the emergency stop system when the emergency stop switch 46 is actuated, there is an overload fuse 54 in the central control-side lead 50 to the first switch contact 56 designed as a break contact. Furthermore, there is in the emergency stop switch 46 a second forced switch contact 64 designed as a make contact, the first terminal 66 of which is connected to the ground terminal 26 of the voltage source, and the second terminal 62 of which is connected to the second terminal 58 of the first switch contact 56 within the remote control unit 14. The embodiments of the invention in which an exclusive property or privilege is claimed are defined as follows:

In the claims:

1. A switch device comprising:

a remote control unit having a mechanically actuable emergency stop switch, said emergency stop switch including first and second switch contacts, each switch contact having first and second terminals, said emergency stop switch being adapted to cut-off operation of a machine even if Power supplied thereto is interrupted;

a central control device for controlling parts and signalling elements of a machine, the central control device having an emergency stop switch device operatable by one of said emergency stop switch a key, the emergency stop switch device including a power supply connecting terminal;

a power supply having a positive pole and a ground pole, the positive pole being connected through a fuse to the first terminal of the first switch contact of the emergency stop switch; and a multicore remote control cable connecting the central control device to the remote control unit;

the second terminal of the first switch contact being connected to the power supply connecting terminal of the emergency stop switch device, the first terminal of the second switch contact being connected to the ground pole of the power supply, the second terminal of the second switch contact being connected to the second terminal of the first switch contact;

the first switch contact of the emergency stop switch being adapted to break contact in an emergency stop and being connected at the first terminal through a first cable core of the remote control cable to the positive pole of the power supply, the second terminal of the first switch contact being connected through a second cable core of the remote control cable to the power supply connecting terminal of the emergency stop switch device, the second switch contact being adapted to make contact in an emergency stop, the first terminal of the second switch contact being connected through a third cable core of the remote control cable to the ground pole of the power supply, the first and the second switch contact being adapted to be forcedly guided and being adapted to react timely one after the other upon operation of the emergency stop switch.

2. The switch device according to claim 1, wherein the first and second switch contacts are combined in a changeover switch.

3. The switch device according to claim 1, wherein said power supply is a voltage source, said voltage source being housed in said central control device.

4. The switch device according to claim 3, wherein said first and second cable cores have a shielding cover connected to said ground pole.

5. A switch device comprising:

a central control device for controlling parts and signalling elements of a machine, the central control device having an emergency stop switch device for signaling main and control circuits connected to stop operation of the parts and the signalling elements, the emergency stop switch device having a power supply terminal, a mechanically actuable emergency stop switch being adapted to signal an emergency stop to the emergency stop switch device, the emergency stop switch having a switch contact, a power supply supplying power to the central control and emergency stop switch, the power supply having positive and ground poles, the emergency stop switch being adapted to trigger an emergency cut-off upon interruption of the power supply, the power supply being housed in the central control device, the switch contact having first and second terminals, the first terminal being connected through an overload fuse to the positive pole, the second terminal being connected to the power supply connecting terminal of the emergency stop switch device, a remote control unit having a multicore remote control cable connected to the central control device, the emergency stop switch being arranged in the remote control unit, the first terminal of the switch contact of the emergency stop switch being connected through a first cable core of the remote control cable to the positive pole of the power supply and the second terminal being connected through a second cable core of the remote control cable to the power supply terminal of the emergency stop switch device, and a shielding cover connected to the ground pole of the voltage source covering at least one of the first and second cable cores.

6. A device for controlling operation of a material distributing machine, comprising a central control device, a remote control unit, a multicore cable connecting said central control device and said remote control unit, and an electrical power supply having a positive pole and a ground pole, said central control device including circuits controlling parts of the machine and emergency stop device having means for manually stopping operation of the machine and having an output and a power supply terminal, said output of said emergency stop device being connected to said circuits, said remote control unit including an emergency stop switch for stopping operation of the machine when power from the power supply is interrupted to said remote control device, said emergency stop switch having operation and stop positions and first and second switch contacts, said first switch having first and second terminals, said first and second terminals being electrically connected in the operation position of said emergency stop switch and being open circuited in the stop position of said emergency stop switch, said second switch contact having third and fourth terminals, said third and fourth terminals being open circuited in the operation position of said emergency stop switch and being electrically connected in the stop position of said emergency stop switch, said first terminal being connected to said positive pole of said electrical power supply through a first cable of said multicore cable, said second terminal being connected to said power supply terminal of said emergency stop device through a second cable of said multicore cable, said third terminal being connected to said ground pole through a third cable of said multicore cable, said fourth terminal being connected to said second terminal, and said second switch contact connecting the positive pole to the ground pole preventing electrical power from reaching said power supply terminal even if said multicore cable is shorted to stop operation of the machine when the emergency stop switch is in the stop position.

7. The device according to claim 6, wherein said central control device includes an overload fuse and a central stop switch, said fuse being connected between said positive pole and a fifth terminal of said central stop switch, and a sixth terminal of said central stop switch being connected to said first terminal of said first switch contact through said first cable.

* * * * *

UNITED STATES PATENT AND TRADEMARK OFFICE

CERTIFICATE OF CORRECTION

PATENT NO. : 5 757 088

DATED : May 26, 1998

INVENTOR(S) : Paul BAEUMEN et al

It is certified that error appears in the above-indentified patent and that said Letters Patent is hereby corrected as shown below:

Column 4, line 43; after "switch" insert ---or---.

Signed and Sealed this

Thirteenth Day of October 1998

*Attest:*

*Attesting Officer*

BRUCE LEHMAN

*Commissioner of Patents and Trademarks*